US010857056B2

(12) United States Patent
Mass et al.

(10) Patent No.: US 10,857,056 B2
(45) Date of Patent: Dec. 8, 2020

(54) FOLDABLE WALKER

(71) Applicant: Medline Industries, Inc., Northfield, IL (US)

(72) Inventors: Paige Mass, Minooka, IL (US); Nirja Shah, Buffalo Grove, IL (US); Vasundhara Agrawal, Rudrapur (IN); Yixuan Tong, Chicago, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 16/611,127

(22) PCT Filed: May 4, 2018

(86) PCT No.: PCT/US2018/031036

§ 371 (c)(1),
(2) Date: Nov. 5, 2019

(87) PCT Pub. No.: WO2018/213021

PCT Pub. Date: Nov. 22, 2018

(65) Prior Publication Data

US 2020/0078255 A1 Mar. 12, 2020

Related U.S. Application Data

(60) Provisional application No. 62/518,957, filed on Jun. 13, 2017, provisional application No. 62/516,814, (Continued)

(51) Int. Cl.
*A61H 3/00* (2006.01)

(52) U.S. Cl.
CPC ..... *A61H 3/00* (2013.01); *A61H 2201/0161* (2013.01)

(58) Field of Classification Search
CPC ..... A61H 3/00; A61H 2201/0161
See application file for complete search history.

(56) References Cited

U.S. PATENT DOCUMENTS 3,516,425 A * 6/1970 Rigal ..... A61H 3/00 135/67
3,690,652 A * 9/1972 Schneider ..... A61H 3/00 482/66

(Continued)

FOREIGN PATENT DOCUMENTS

CN 202654373 1/2013
CN 202892341 4/2013

(Continued)

OTHER PUBLICATIONS

International Search Report and Written Opinion for International Application No. PCT/US2018/031036 dated Sep. 3, 2018.

*Primary Examiner* — Noah Chandler Hawk
(74) *Attorney, Agent, or Firm* — Fitch, Even, Tabin & Flannery LLP

(57) ABSTRACT

A walker is provided that is movable between a compact, folded configuration and an expanded configuration. The walker includes a pair of side frames, each with a forward leg and a rearward leg. The legs are joined at their top portions by an upper support member. A cross member extends between the forward legs of each of the pair of side frames. The cross member has a hinge disposed between the forward legs. The components of the cross member can be folded relative to one another about the hinge to move the walker between the expanded and folded configurations, which allows for the frames to be positioned in an adjacent and generally aligned orientation when folded. The hinge has a locking mechanism for locking the hinge in the expanded configuration.

9 Claims, 10 Drawing Sheets

Related U.S. Application Data filed on Jun. 8, 2017, provisional application No. 62/508,813, filed on May 19, 2017.

(56) References Cited

U.S. PATENT DOCUMENTS

| | | | | | |
|---|---|---|---|---|---|
| 3,945,389 | A * | 3/1976 | Smith | A61H 3/00 | 135/67 |
| 4,180,086 | A * | 12/1979 | Thomas | A61H 3/00 | 135/67 |
| 4,481,965 | A * | 11/1984 | Watkins | A61H 3/00 | 135/67 |
| 5,201,333 | A * | 4/1993 | Shalmon | A61H 3/00 | 135/67 |
| 5,555,954 | A * | 9/1996 | Swiderski | E04G 1/34 | 182/119 |
| 6,206,019 | B1 * | 3/2001 | Horvitz | A61H 3/00 | 135/66 |
| 7,373,942 | B1 | 5/2008 | Yeager | | |
| 9,228,601 | B2 | 1/2016 | Fang | | |
| 9,554,961 | B1 | 1/2017 | Juarez | | |
| 9,707,149 | B1 * | 7/2017 | Juarez | A61H 3/00 | |
| 2014/0109943 | A1 | 4/2014 | Fang | | |

FOREIGN PATENT DOCUMENTS

| | | |
|---|---|---|
| CN | 203885808 | 10/2014 |
| CN | 208770312 | 4/2019 |
| JP | 2008220643 | 9/2008 |

* cited by examiner

FOLDABLE WALKER

FIELD

The disclosure is in the field of medical devices and in particular assisted movement devices. A walker is described herein, and, in particular, a walker that is configured to be foldable between and expanded configuration and a more compact, collapsed configuration.

BACKGROUND

Walkers are assisted movement devices that are used by persons in need of support while standing or walking. Conventional walkers can have a pair of side frames where each side frame has a pair of feet, an upper support member, and a lower support member. The pair of frames can be pivotable about the upper and lower support members to move the walker between an expanded configuration and a compact, collapsed configuration. In the collapsed configuration, the frames may be offset from one another, and thus may not be as compact as desirable for shipping and storage. For example, the walker disclosed in U.S. Pat. No. 3,516,425 has a pair of foldable support members that allow for the frames to be positioned in an adjacent, aligned arrangement, as shown in FIG. 3 of that patent. However, the pivot members of the foldable support members are not locked, which can lead to inadvertent folding. This can cause serious injury to the user.

Desirably, a walker should be resistant to inadvertent folding. A walker so constructed is now disclosed.

DETAILED DESCRIPTION

Figure 1A:
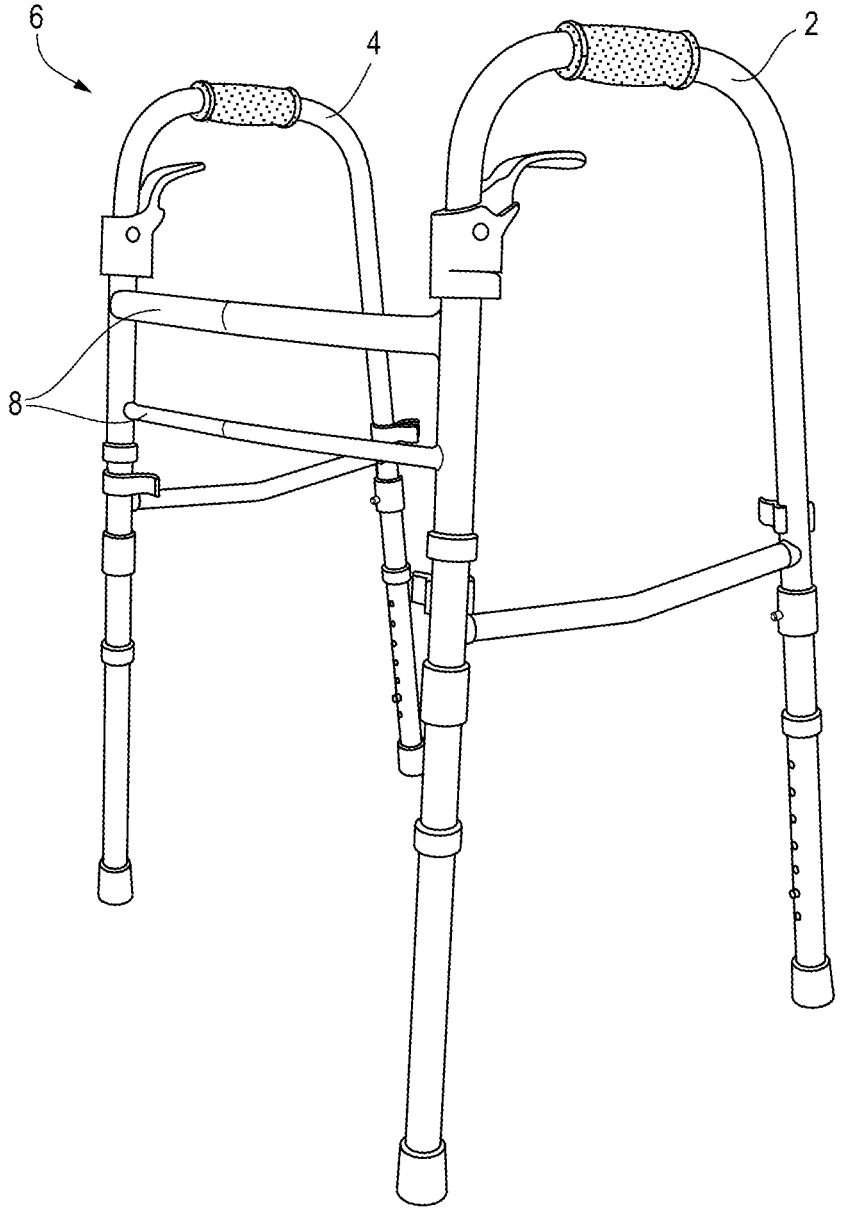
FIG. 1A PRIOR ART
FIGS. 1A and 1B are respectively a front perspective view of a prior art walker and a perspective view of the prior art walker in a folded position.

A walker is provided that is movable between a compact, folded configuration and an expanded configuration, the expanded configuration being the position that the walker is configured in for typical use and the folded configuration being the typical configuration for transport or storage. The walker is movable over a range of intermediate positions between the expanded and folded configurations. As is typical for walkers, the walker includes a pair of side frames, with each of the side frames having a forward leg and a rearward leg. The legs are joined at their top portions by an upper support member and, optionally, in their lower or middle portions by a lower support member. A cross member extends between the forward legs of each of the pair of side frames. The cross member comprises first and second components connected at a hinge that generally is disposed between the forward legs. The cross member can be folded about the hinge and is rotatable relative to the frame to allow the walker to move between the expanded and folded configurations, which can advantageously allow for the frames to be positioned in a compact, adjacent and generally aligned orientation when folded. The hinge has a locking mechanism for locking the hinge in the expanded configuration. The locking mechanism can be actuated via an unlock mechanism, which may be positioned relative to one of the side frames, such as one of the forward legs of one of the side frames, thereby allowing for ease of unlocking by a user while also restricting inadvertent folding.

Locking mechanisms can also be provided to block rotation of the cross member relative to each of the pair of frames. When combined with the locking mechanism associated with the hinge, a three-stage unlocking process can optionally be provided to restrict unintentional folding of the walker. More specifically, and in any order appropriate, the first stage of the unlocking process can include unlocking the cross member relative to a first of the side frames for rotation of the cross member relative to the first of the side frames. The second stage of the unlocking process can include actuating the unlocking mechanism associated with the hinge of the cross member to permit the cross member to be folded about the hinge. Optionally, rotation of the first side frame relative to the cross member can actuate the unlocking mechanism associated with the hinge. The third stage of the unlocking process is similar to the first stage, but with respect to a second of the side frames. That is, the unlocking of the cross member relative to the second of the side frames for rotation of the cross member relative to the second of the side frames. The walker may be provided with four leg assemblies as illustrated, or with a pair of leg assemblies and a pair of wheels or wheel assemblies (not shown) that are removable from the walker. The leg assemblies are telescoping structures that permit adjustment of the height of the walker and that collapse into compact forms for storage.

In some embodiments, the cross member can include a first component and a second component joined at the hinge. The first component can extend between one of the pair of side frames and the hinge and the second component can extend between the other of the pair of side frames and the hinge. The first cross member component may be coupled to a first sleeve in which the forward leg of the one of the pair of side frames is rotatably disposed, and the second cross member component may be coupled to a second sleeve in which the forward leg of the other one of the pair of side frames is rotatably disposed.

Preferably, though not necessarily, only a single cross member is provided. In some aspects, the cross member can include a pair of diagonal braces, with a first of the braces extending from the first sleeve to the first component and the second of the braces extending from the second sleeve to the second component. The braces can result in the cross member having a generally K-shaped appearance.

An actuator can be pivotably attached relative to one of the pair of side frames. The actuator can be a handle that is pivoted to unlock the cross member for rotation relative to the one of the pair of side frames. More specifically, the actuator has a locked position whereby rotation of the one of the pair of side frames relative to the cross member is blocked and an unlocked position whereby the one of the pair of side frames is rotatable relative to the cross member.

In some aspects, the locking mechanism can further include a locking pin associated with the hinge. The pin has a locked position, preventing rotation about the hinge, and an unlocked position, allowing rotation about the hinge. The pin can optionally be spring biased toward the locked position.

A pivot housing is disposed at least partially over the locking pin and operably connected relative to the locking pin via a flexible cable. The pivot housing having a pivot axis relative to the hinge and being pivotable between a first position, whereby the locking pin is in the locked position, and a second position, whereby the locking pin is in the unlocked position, with the movement of the pivot housing from the first position to the second position causing the flexible cable to pull the locking pin from the locked position to the unlocked position to thereby permit the cross member to be folded about the hinge. The locking mechanism may include an actuator cable that extends between the pivot housing and the one of the pair of side frames, the cable having a length such that rotation of the one of the pair of side frames relative to the cross member from the unfolded toward the folded configuration causes the pivot housing to move from the first position to the second position and, in turn, the locking pin to move from the locked position to the unlocked position.

A method of moving the walker described herein from the expanded configuration to the folded configuration can include the steps of unlocking the hinge by rotating one of the pair of side frames relative to the cross member and away from the other of the pair of side frames, folding the cross member about the hinge, and rotating the other of the pair of side frames relative to the cross member and toward the one of the pair of side frames. Each of the side frames can have its own locking mechanisms for selectively restricting its rotation relative to the cross member.

The walker described herein can be provided, such as during shipping or at point of sale, in a folded, compact configuration. In such a configuration, the pair of side frames are in a generally adjacent, aligned arrangement as opposed to being offset. The cross member is provided folded about the hinge such that the hinge is positioned between the pair of side frames and between the forward and rearward legs thereof. This compact configuration is also suitable for storage of the walker.

Figure 1B:
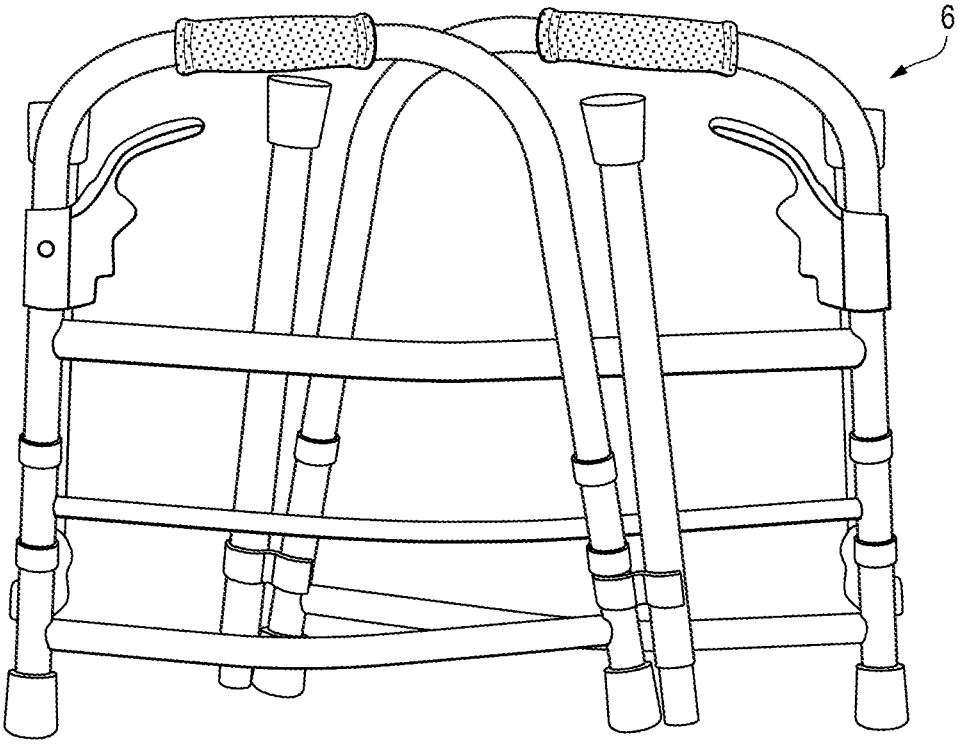
FIG. 1B PRIOR ART
Figure 2:
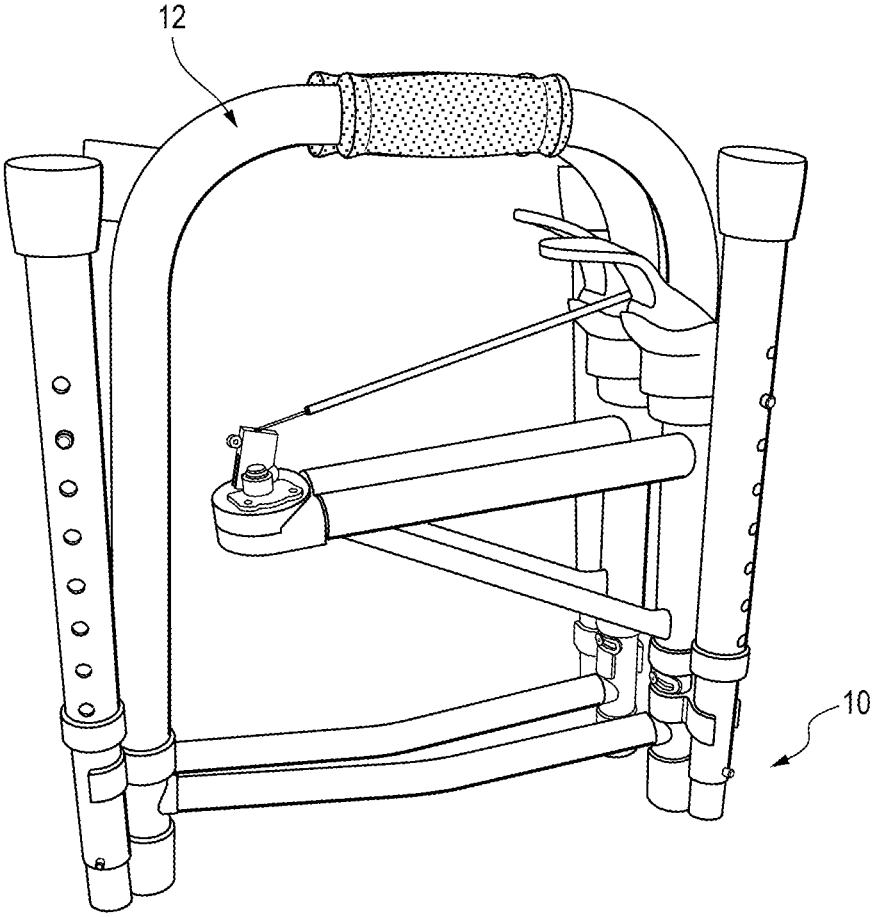
FIG. 2 is a side elevational view of the presently inventive walker in a folded configuration and shown the frames in an adjacent, aligned arrangement.
Figure 3:
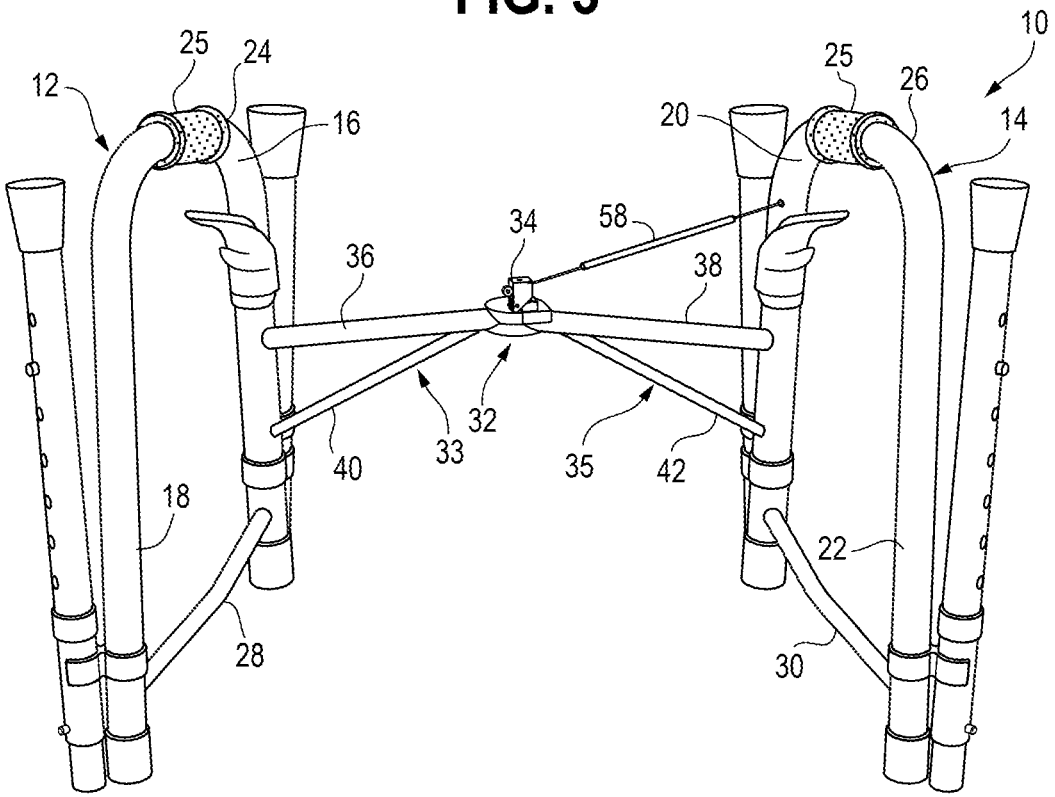
FIG. 3 is rear perspective view of the walker of FIG. 2 but in a partially unfolded configuration, showing the frames spaced apart by a hinged cross member and the leg assemblies in a storage position.
Figure 4:
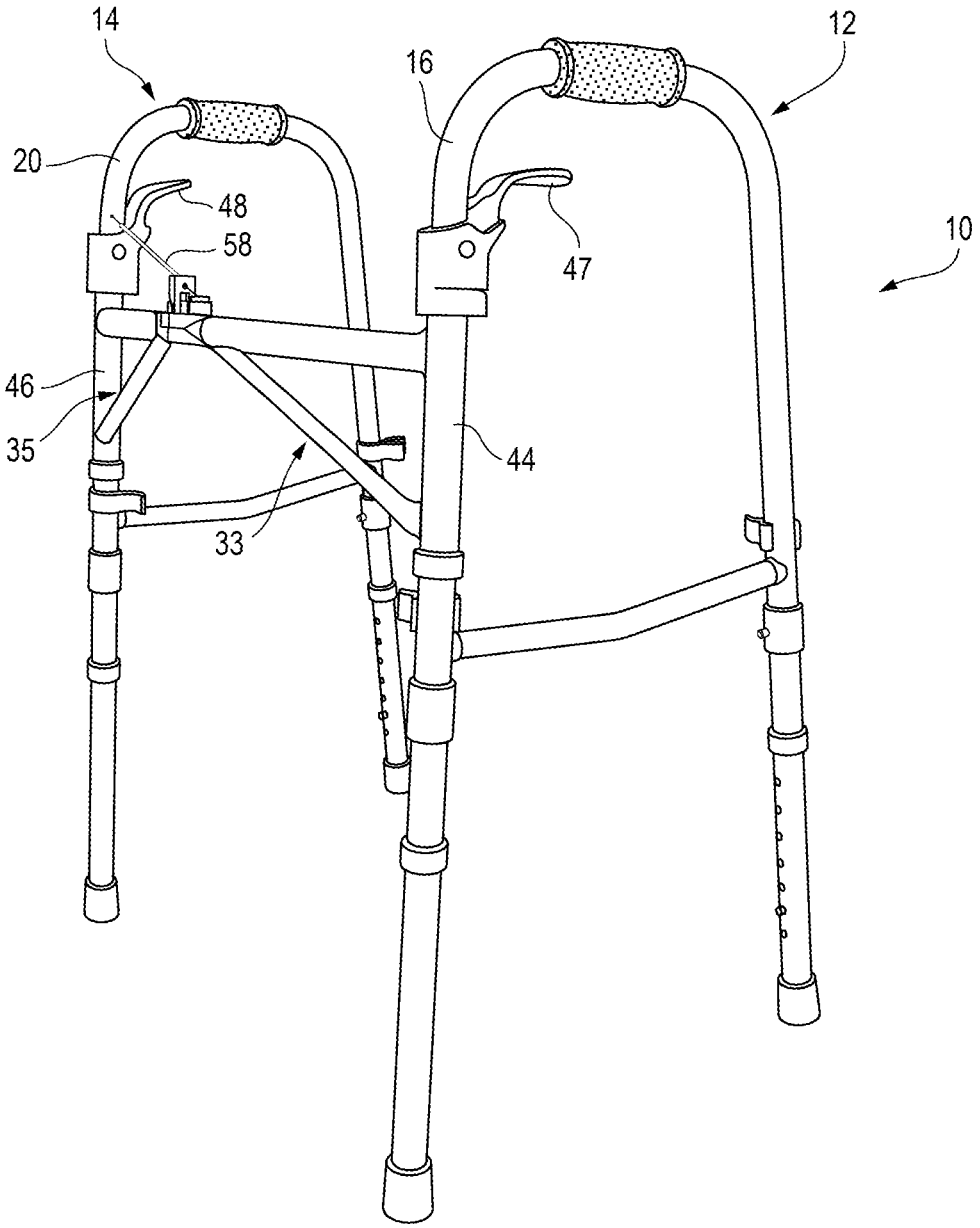
FIG. 4 is a front perspective view of the walker of FIG. 2 but in a fully assembled configuration, showing the frames spaced apart by the hinged cross member and the leg assemblies positioned for use.
Figure 5:
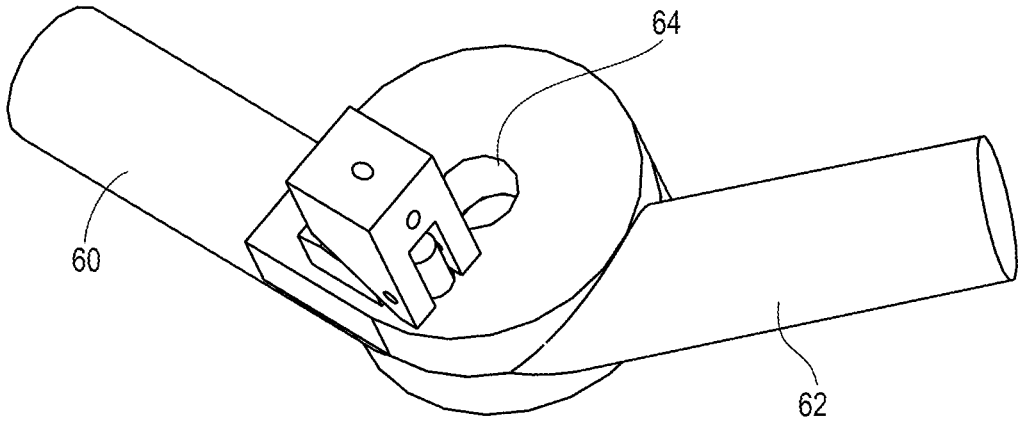
FIG. 5 is a perspective view of a hinge assembly of the hinged cross member of the walker of FIG. 2.

With reference now to the Figures, the prior art walker 6 shown in FIGS. 1A and 1B is shown in the normal operating configuration in FIG. 1A and in a relatively more compact storage configuration in FIG. 1B. With reference to FIGS. 2-4, the presently inventive walker 10 is also movable between a compact, folded configuration, as shown in FIG. 2, and a normal operating expanded configuration, as shown in FIG. 4. As is typical for walkers, and with particular reference to FIG. 3, the walker 10 includes a pair of side frames 12, 14, with each of the side frames 12, 14 having a forward leg 16, 20 and a rearward leg 18, 22, and upper support members 24, 26 and lower support members 28, 30. The upper support members 24, 26 can include grips 25 for the comfort of a user, such as a covering of rubber or polymeric material.

The side frames 12, 14, are connected via a cross member structure 32. As shown, the cross member structure 32 comprises first and second cross member components, which, in the illustrated embodiment, comprise truss structures 33, 35 connected to one another at the central portion of the walker at a hinge 34 to generally form a K-shaped structure. The truss structures comprise main components 36, 38 and diagonal braces 40, 42. The hinge 34 allows for reconfiguration of the walker 10 between the expanded and folded configurations, which can advantageously allow for the frames 12, 14 to be positioned in a compact position when folded, as shown in FIG. 2. This can result in a more compact folded configuration as compared to a prior art walker 6, shown in FIG. 1, where the cross members 8 are rigid and the frames 2, 4 are offset relative to each other when folded.

With particular reference to FIG. 4, the truss structures 33, 35 are connected generally to a pair of tubular sleeves 44, 46 within which reside the forward legs 16, 20 of the side frames 12, 14. The side frames 12, 14 are rotatable with respect to the tubular sleeves 44, 46. In normal use, the side frames are rotationally locked relative to the tubular sleeves to inhibit inadvertent rotation. Each sleeve is provided with a locking mechanism that includes a paddle handle 47, 48 and a spring-loaded tubular sleeve locking pin (not shown) operably connected to each of the paddle handles and engaging a socket (not shown) in the front legs 16, 20. To collapse the walker, the paddle handles 47, 48 are depressed, causing of each of the handles 47, 48 to pivot about the pivot axis. Depression of the paddle handles 47, 48 retracts the tubular sleeve locking pin from the opening of the forward leg 16, 20 in order to allow the side frames 12, 14 to rotate relative to the tubular sleeves 44, 46, and thus rotate relative to the cross member structure 32.

Figure 6A:
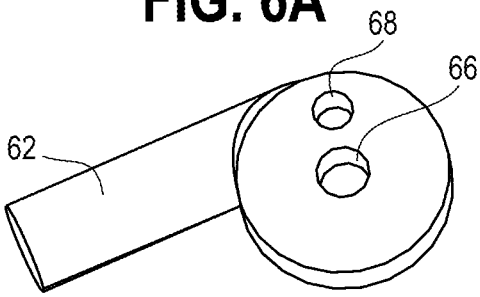
FIG. 6A-6D collectively illustrates the disassembled components of the hinge assembly of FIG. 5.
Figure 6B:
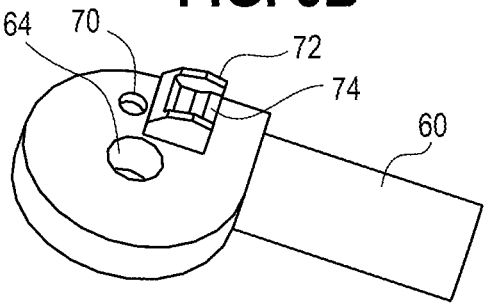

The hinge 34 is likewise normally maintained in a locked state to restrict inadvertent collapse of the walker 10. As, shown in FIGS. 5-8, the hinge 34 includes a first hinge side 60 and a second hinge side 62. Each of the sides 60, 62 has a plate and the two plates rotate against each other about a pivot axis defined by apertures formed in each of the two plates. More specifically, the first hinge side 60 includes a plate with a central aperture 64, and the second hinge side 62 also includes a plate with a central aperture 66, as best shown in FIGS. 6A and 6B. A hinge pin (not shown) can extend through the apertures 64, 66 to define the pivot axis of the hinge 34. The first hinge side 60 is connected to the second main component 38 and the second hinge side 62 is connected to the first main component 36.

Each of the plates of the first and second hinge sides 60, 62 also includes an offset aperture 70, 68 spaced from the pivot axis. The locking mechanism of the illustrated embodiment includes a locking pin 82 (FIG. 6C) that can be slidably received within the offset apertures 70, 68 of the hinge 34. When the locking pin 82 is in a retracted position, it is disengaged from the offset aperture 68 of the second hinge side 62, such that the first and second hinge sides 60, 62 are pivotable relative to each other about the pivot axis, as discussed in more detail below. However, when the locking pin 82 is in an extended position, it extends through the offset aperture 70 of the first hinge side 60 and partially through the offset aperture 68 of the second hinge side 62, thereby preventing relative rotation between the first and second hinge sides 60, 62 about the pivot axis.

Figure 6C:
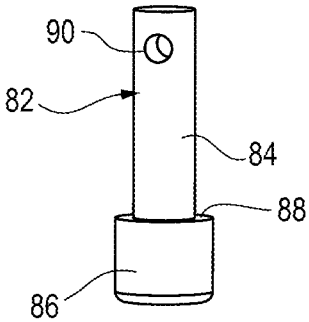
Figure 8A:
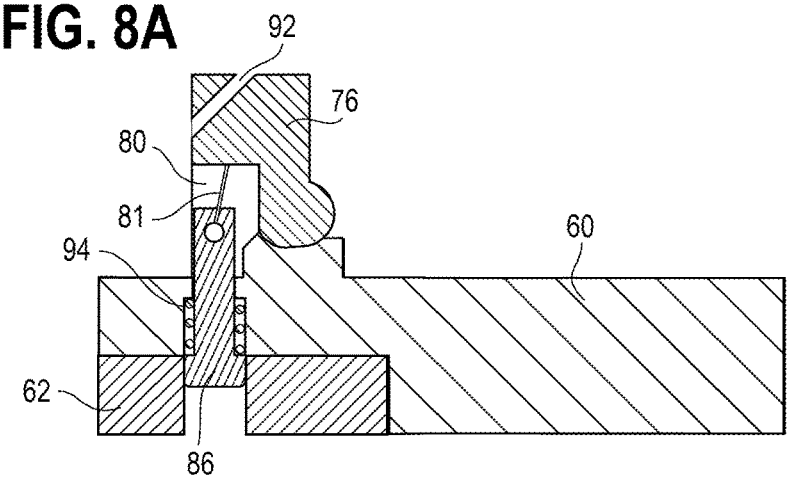
FIG. 8A is a section view of the hinge assembly of FIG. 5, taken along line VIII-VIII of FIG. 7, showing the hinge pin in an extended position.

The locking pin 82 is biased by a spring 94 toward its extended position, as shown in FIG. 8A. More specifically, the locking pin 82 has an enlarged head 86 disposed at one end of a narrower shaft 84, as shown in FIG. 6C. A step 88 is formed at the intersection of the enlarged head 86 and the narrower shaft 84, as shown in FIG. 6C. The spring 94 is disposed about the narrower shaft 84, with one end of the spring 94 abutting the step 88. The opposite end of the spring 94 abuts a surface of the first hinge side 60 to bias the locking pin 82 toward the extended position.

Figure 6D:
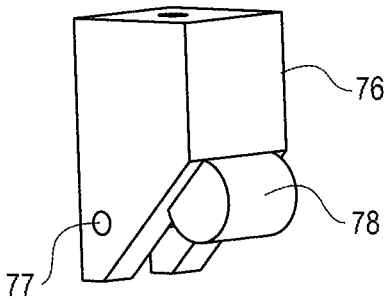
Figure 7:
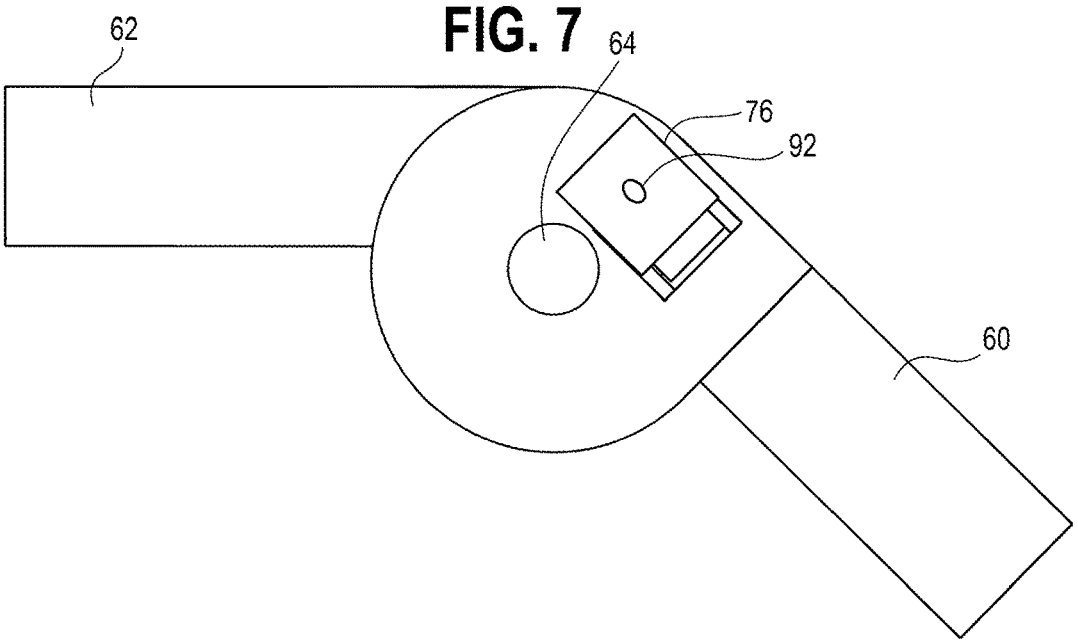
FIG. 7 is a top plan view of the hinge assembly of FIG. 5.
Figure 8B:
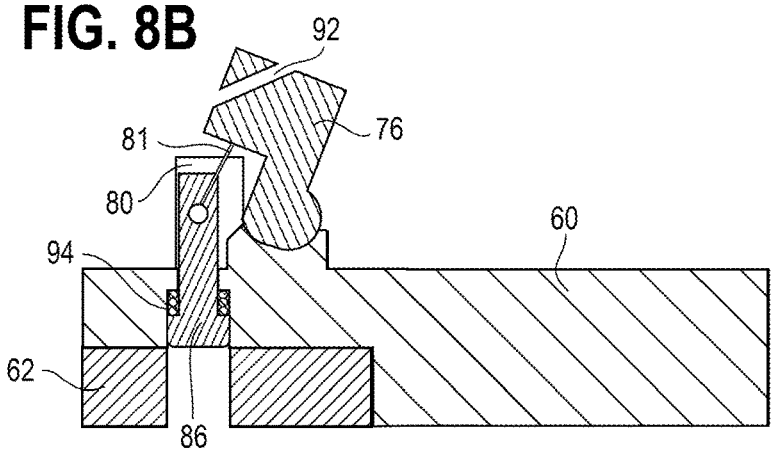
FIG. 8B is a section view of the hinge assembly shown in FIG. 5, shown when the hinge pin is in a retracted position.
Figure 9A:
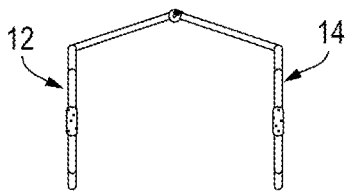
FIGS. 9A-9E are diagrammatic top views of the walker shown in FIG. 2 being moved from an expanded configuration to a collapsed, folded configuration.
Figure 9B:
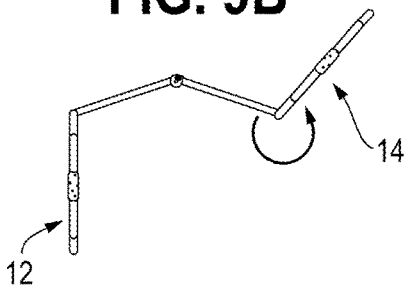
Figure 9C:
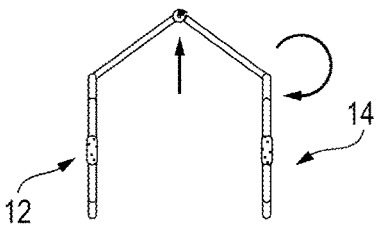
Figure 9D:
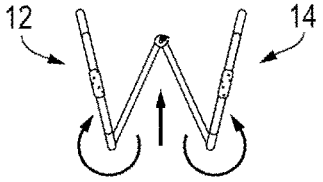
Figure 9E:
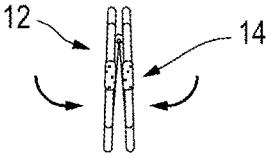

Movement of the locking pin 82 from the extended position, whereby rotation of the first and second hinge sides 60, 62 about the pivot axis is blocked, to the retracted position, whereby rotation about the pivot axis is permitted, is controlled operation of a tilt mechanism. The tilt mechanism includes a pivot housing 76 having a forward facing interior cavity 80 and a rearward facing curved pivot surface 78, as shown in FIG. 8A. The plate of the first hinge side 60 includes a pivot housing mount 72 with a socket 74 with a surface for mating with the curved pivot surface 78 of the pivot housing 76 (FIGS. 6B and 6D). A pivot pin cable 81 (FIGS. 8A and 8B) extends between an aperture 90 (FIG. 6C) in the narrower shaft 84 of the locking pin 82 and an interior surface of the pivot housing mount 72. When assembled, the locking pin 82 is disposed partially within the interior cavity 80 of the pivot housing 76. When the pivot housing 76 is titled rearward about the curved pivot surface 78, the pivot pin cable 81 pulls the locking pin 82 from within the offset aperture 68 of the second hinge side 62, thereby withdrawing the locking pin 82 from the offset aperture 68 of the second hinge side 62, as shown in FIG. 8B. This permits rotation of the first and second hinge sides 60, 62 about the pivot axis. Instead of a pivot pin cable, a cross-rod can extend through the aperture 90 of the locking pin 82 and into a pair of apertures of the pivot housing mount 72 (one aperture shown as aperture 77 in FIG. 6D). The locking pin 82 can be rotatable about the cross-rod, and/or the pivot housing 76 about the cross-rod.

To cause the pivot housing 76 to tilt rearward, an actuator cable 58 extends between the pivot housing 76 and the forward leg of one of the side frames 12 or 14, as shown in FIGS. 3 and 4. One end of the actuator cable 58 extends through an angled aperture 92 (FIG. 7) of the pivot housing 76, with an enlarged element (not shown) attached at the free end of the actuator cable 58 to prevent it from being pulled out of the angled aperture 92. The opposite end of the actuator cable 58 is secured to the forward leg of one of the side frames, such as by extending through an opening thereof or otherwise being anchored. The length of the actuator cable 58 is selected to bias the pivot housing 76 is rearwardly to a sufficient degree to cause the pivot pin 82 to be pulled, against the biasing force of the spring 94, from within the offset aperture 68 of the second hinge side 62 to thereby permit rotation of the first and second hinge sides 60, 62 about the pivot axis. This is accomplished by partially winding the actuator cable 58 about the forward leg of the first side frame, which is accomplished by rotation of the forward leg of the first side frame (14 in the illustrated embodiment) within the associated tubular sleeve (6 in the illustrated embodiment). The actuator cable 58 can be attached to either of the first and second frames 12, 14, provided that it is positioned to tilt the pivot housing 76.

To fold the walker from the expanded configuration to the compact, collapsed configuration, as series of pivoting movements is performed, as diagrammatically shown in FIG. 9. Starting from the expanded configuration, the side frame 14 to which the actuator cable 58 (not shown in FIGS. 9A-9E) is connected is rotated about its forward leg outwardly, away from the second side frame 12 after unlocking using the associated paddle handle. With continuing reference to the locking mechanism depicted previously, movement of this side frame 14 causes the actuator cable 58 to bias the pivot housing 76 rearward and, in turn, pulling the pivot pin 82 from within the offset aperture 68 of the second hinge side 62 to thereby permit rotation of the first and second hinge sides 60, 62 about the pivot axis. This allows the cross member structure 32 to fold about the hinge 34. After unlocking the associated paddle handle, the walker is collapsed and into a position whereby the first and second side frames 12, 14 are aligned, as shown in FIG. 9E and in FIG. 2. The steps can be repeated in reverse in order to move the walker from the collapsed configuration to the unfolded, expanded configuration. The unfolding does not require the various locking mechanisms to be disengaged, as they are already disengaged at this point, but will automatically re-engage once in the expanded configuration.

Figure 10:
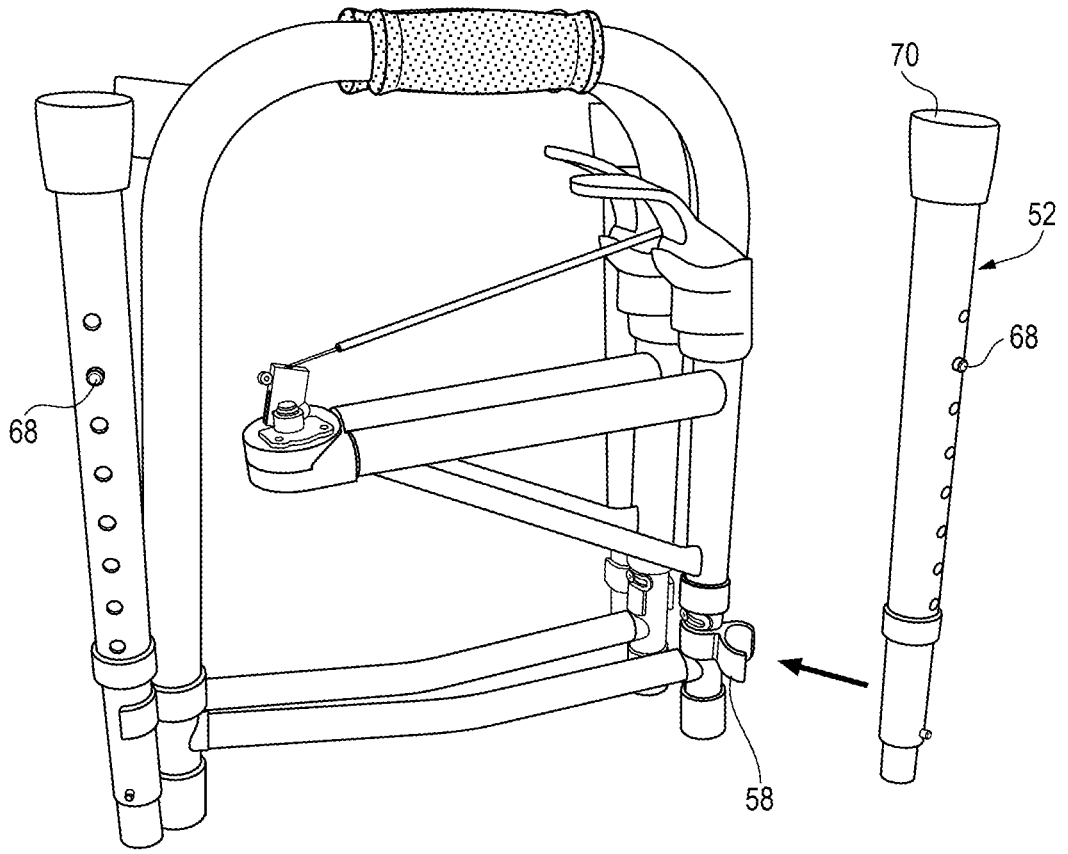
FIG. 10 is a side elevational view of the walker of FIG. 2 illustrating placement of the leg assembly into a storage position.
Figure 11:
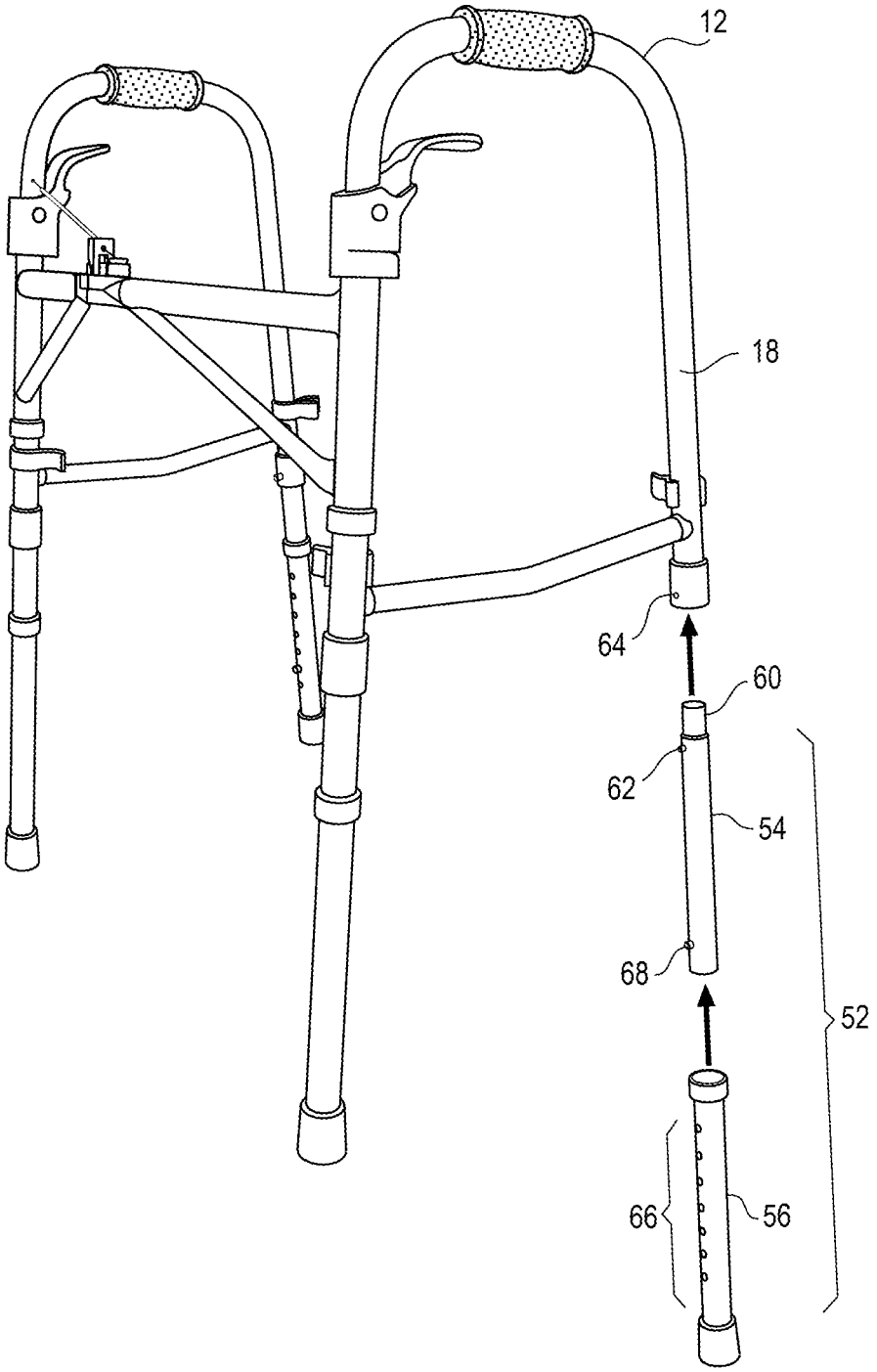
FIG. 11 is perspective view of the walker as shown in FIG. 4 but depicting one of the leg assemblies of the walker in an exploded view.

To further provide a more compact configuration, the legs 16/18, 20/22 of each of the frames 12, 14 can optionally comprise separate lower leg assembly sections. With reference to FIGS. 10 and 11, leg assembly 52 comprises telescoping inner and outer leg assembly sections 54, 56 that are collapsible into a compact form and securable to the other components of the walker via a clip 58. The inner leg assembly section 54 includes a narrowed upper end 60 sized for insertion into the respective leg section (18 in this instance) of the respective side frame (12). The inner section 54 is provided with a spring-loaded pin 62 that engages a mounting hole 64 in the leg section 16. The outer leg assembly section 56 includes a series of mounting holes 66 sized to engage a second spring-loaded pin 68 disposed in the inner leg assembly section 54 (a second pin 68 is shown in FIG. 10), which permit adjustment of the height of the walker. The outer leg assembly section is provided with an elastomeric foot 70 or optional wheel (not shown) for the front leg section. Conventional spring-loaded pins may be employed, or other suitable structures such as bolts and wing nuts (not shown) may be used. The other leg assemblies may be substantially similarly configured.

Via the above, it is seen that a walker that is resistant to inadvertent folding and that is foldable into a compact configuration may be provided.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

The invention claimed is:

1. A walker comprising:

a pair of side frames, each of the side frames having a forward leg and a rearward leg, the forward leg and the rearward leg being joined at their top portions by an upper support member; and a cross member extending between the forward legs of each of the pair of side frames, the cross member comprising first and second cross member components, the cross member components being foldable relative to one another about a hinge, each of the cross member components being rotatable relative to one of the side frames to permit movement of the walker between expanded and folded configurations, whereby in the folded configuration the side frames are closer together as compared to the expanded configuration and the cross member components are folded about the hinge;

wherein the hinge includes a locking pin that is movable between a locked position in which the cross member components are prevented from rotating about the hinge, and an unlocked position in which the cross member components are permitted to rotate about the hinge;

wherein a pivot housing is disposed at least partially over the locking pin and is operably connected to the locking pin, the pivot housing being pivotable between a first position wherein the locking pin is in the locked position, and a second position wherein the locking pin is in the unlocked position;

the pivot housing being connected to the locking pin via a flexible cable, the movement of the pivot housing from the first position to the second position causing the flexible cable to pull the locking pin from the locked position to the unlocked position.

2. The walker of claim 1, the first cross member component extending between one of the pair of side frames and the hinge and the second cross member component extending between the other of the pair of side frames and the hinge, and wherein the first cross member component is coupled to a first sleeve in which the forward leg of the one of the pair of side frames is rotatably disposed, and the second cross member component is coupled to a second sleeve in which the forward leg of the other one of the pair of side frames is rotatably disposed.

3. The walker of claim 2, wherein the cross member includes a pair of braces, with a first of the braces extending from the first sleeve to the first cross member component and the second of the braces extending from the second sleeve to the second cross member component.

4. The walker of claim 1, wherein each of the forward and rearward legs has an extensible leg with a foot at one end and an opposite end for slidably engaging one of the each of the forward and rearward legs, the foot of each extensible leg being closer to the lower support member in the folded configuration as compared to the expanded configuration.

5. The walker of claim 1, wherein a grip is provided on each of the upper support members.

6. The walker of claim 1, wherein an actuator cable extends between the pivot housing and the one of the pair of side frames, the cable having a length such that rotation of the one of the pair of side frames relative to the cross member from the unfolded toward the folded configuration causes the pivot housing to move from the first position to the second position and the locking pin to move from the locked position to the unlocked position.

7. The walker of claim 6, wherein the locking pin is biased by a spring toward its locked position.

8. The walker of claim 1, the pair of side frames being further joined by a lower support member; the hinge being disposed below the upper support members and above the lower support members.

9. The walker of claim 8, the hinge being disposed between the forward leg and rearward leg when in the folded configuration.

* * * * *